US006655161B1

(12) United States Patent
Koo

(10) Patent No.: US 6,655,161 B1
(45) Date of Patent: Dec. 2, 2003

(54) AIR CONDITIONER AND CONTROL METHOD THEREOF

(75) Inventor: Hyoung-Mo Koo, Suwon (KR)

(73) Assignee: Samsung Electronics Co., Ltd., Suwon (KR)

( * ) Notice: Subject to any disclaimer, the term of this patent is extended or adjusted under 35 U.S.C. 154(b) by 0 days.

(21) Appl. No.: 10/299,724

(22) Filed: Nov. 20, 2002

(30) Foreign Application Priority Data

May 17, 2002 (KR) ..... 2002-0027271

(51) Int. Cl.[7] ..... G01K 13/00; F25B 41/00
(52) U.S. Cl. ..... 62/129; 62/174
(58) Field of Search ..... 62/174, 129, 126, 62/77; 165/11.1; 236/94

(56) References Cited

U.S. PATENT DOCUMENTS 5,009,077 A * 4/1991 Okoshi et al. ..... 62/160
5,279,131 A 1/1994 Urushihata et al.
6,098,412 A * 8/2000 Porter et al. ..... 62/126
6,205,798 B1 * 3/2001 Porter et al. ..... 62/129
6,571,565 B2 * 6/2003 Herrick et al. ..... 62/77

FOREIGN PATENT DOCUMENTS

WO WO 01/94856 12/2001

* cited by examiner

*Primary Examiner*—Marc Norman
(74) *Attorney, Agent, or Firm*—Staas & Halsey LLP

(57) ABSTRACT

An air conditioner includes an outdoor unit, at least one indoor unit and a compressor. The outdoor unit is connected to the indoor unit by a refrigerant pipe to form a closed circuit. The refrigerant pipe is divided into high and low pressure pipes. The air conditioner further includes a refrigerant leakage detecting unit provided on the indoor unit to detect refrigerant leakage, a high pressure pipe shutoff valve provided on the high pressure pipe of the refrigerant pipe, and a low pressure pipe shutoff valve provided on the low pressure pipe of the refrigerant pipe. Refrigerant is restored into the outdoor unit by closing the high pressure pipe shutoff valve and opening the low pressure pipe shutoff valve.

19 Claims, 5 Drawing Sheets

100
118
118'
110
DUCT TYPE
(7000W)
FOUR-WAY CASSETTE TYPE
(5200W)
ONE-WAY CASSETTE TYPE
(2000W)
WALL MOUNTED TYPE
(2000W)
S
108
152
116
106
112
158
122
154
156
134
130
114
160
123
120
104
121
132
128
124
126

AIR CONDITIONER AND CONTROL METHOD THEREOF

CROSS-REFERENCE TO RELATED APPLICATIONS

This application claims the benefit of Korean Application No. 2002-27271, filed May 17, 2002, in the Korean Intellectual Property Office, the disclosure of which is incorporated herein by reference.

BACKGROUND OF THE INVENTION

1. Field of the Invention

The present invention relates generally to air conditioners, and more particularly to a system air conditioner having a plurality of indoor units and method of controlling the air conditioner.

2. Description of the Related Art

In general, air conditioners are machines that automatically and appropriately condition indoor air in residential or office buildings by controlling properties of the indoor air, such as temperature and humidity. Since residents of such residential or office buildings typically desire to accomplish different target conditions of indoor air, and atmospheric environments of the buildings frequently vary, required air conditioning capacities of the air conditioners are frequently changed.

A system air conditioner, in which a plurality of indoor units are connected to a single outdoor unit, is a built-in air conditioner which is planned and designed in accordance with factors such as the air conditioning capacities and locations of the indoor units during a planning or designing stage of a building. In the system air conditioner, refrigerant pipes connected to a single outdoor unit are connected in series to one another to form a single pipeline with a variety of types of indoor units having various capacities and structures, such as, for example, duct type, cassette type and/or wall mounted type indoor units. Therefore, the required air conditioning capacities of the indoor units in the system air conditioner may be different from one another. Furthermore, the indoor units of the system air conditioner are mostly operated independently such that a total required air conditioning capacity of the air conditioner calculated by summing up the individually required air conditioning capacities of the indoor units is variable.

As an example of variable-capacity compressors used in a variable-capacity system air conditioner, a variable-rotation number compressor has been proposed and used. The variable-rotation number compressor is designed such that its compressing capacity is controlled in accordance with a required air conditioning capacity. Thus, the variable-rotation number compressor is controlled by controlling a rotation number of a motor thereof by changing a frequency of a current applied to the motor through inverter control.

SUMMARY OF THE INVENTION

Accordingly, it is an aspect of the present invention to provide an air conditioner and control method thereof, which is capable of rapidly shutting off refrigerant supply when refrigerant is leaked out of a refrigerant pipe connected to indoor units, and restoring leaked refrigerant into an outdoor unit.

The foregoing and other aspects of the present invention are achieved by providing an air conditioner having an outdoor unit, at least one indoor unit and a compressor. The outdoor unit is connected to the indoor unit by a refrigerant pipe to form a closed circuit. The refrigerant pipe is divided into high and low pressure pipes. The air conditioner includes a refrigerant leakage detecting unit provided on the indoor unit to detect refrigerant leakage, a high pressure pipe shutoff valve provided on a high pressure pipe of the refrigerant pipe to shut off a flow of refrigerant between the outdoor unit and the indoor unit when the refrigerant leakage is detected, and a low pressure pipe shutoff valve provided on a low pressure pipe of the refrigerant pipe to shut off a flow of refrigerant between the outdoor unit and the indoor unit when the refrigerant leakage is detected. Refrigerant within the indoor unit is restored into the outdoor unit by dosing the high pressure pipe shutoff valve and opening the low pressure pipe shutoff valve when the refrigerant leakage is detected.

The foregoing and other aspects of the present invention are achieved by providing a method of controlling an air conditioner having an outdoor unit, at least one indoor unit, a compressor, an electric expansion valve, a high pressure pipe shutoff valve and a low pressure cutoff valve. The outdoor unit is connected to the indoor unit by a refrigerant pipe to form a dosed circuit. The refrigerant pipe is divided into high and low pressure pipes. The electric expansion valve is provided on the refrigerant pipe to vary pressure of refrigerant flowing into the indoor unit. The high pressure pipe shutoff valve is provided on a high pressure pipe of the refrigerant pipe, and the low pressure pipe shutoff valve is provided on a low pressure pipe of the refrigerant pipe. The method includes restoring leaked refrigerant by keeping the high pressure pipe shutoff valve dosed and the low pressure pipe shutoff valve opened for a preset period of time when refrigerant leakage is detected, and closing the low pressure pipe shutoff valve and stopping the compressor when the preset period of time elapses.

BRIEF DESCRIPTION OF THE DRAWINGS

The above and other aspects and advantages of the invention will become apparent and more appreciated from the following description of the preferred embodiments, taken in conjunction with the accompanying drawings of which.

DETAILED DESCRIPTION OF THE PREFERRED EMBODIMENTS

Figure 1:
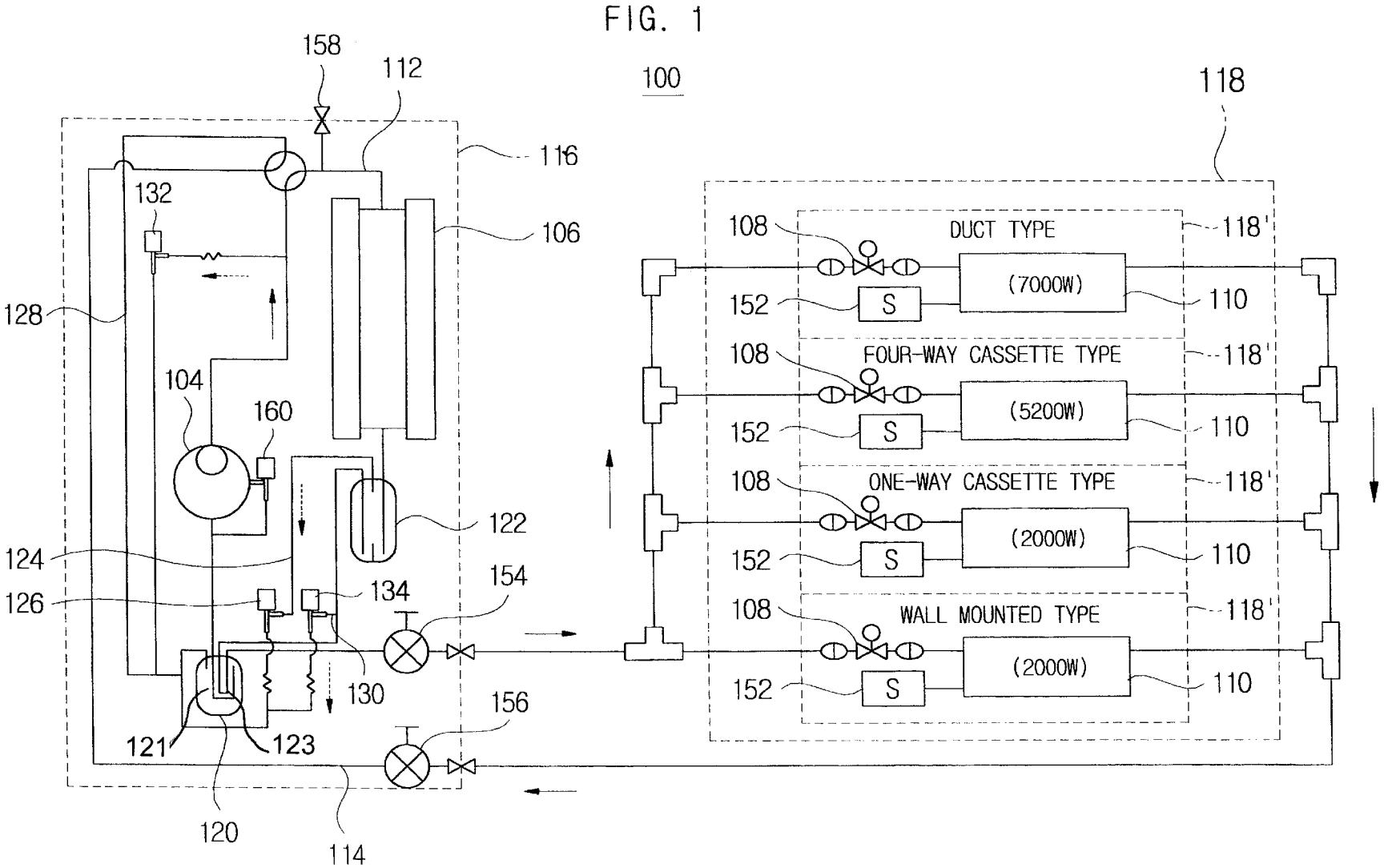
FIG. 1 is a view showing an air conditioner employing a pulse width modulation type compressor, according to an embodiment of the present invention.

Reference will now be made in detail to the present preferred embodiments of the present invention, examples of which are illustrated in the accompanying drawings, wherein like reference numerals refer to like elements throughout.

As an example of the variable-capacity compressors, a pulse width modulation type compressor has been proposed and used. The air conditioner having the pulse width modulation type compressor is disclosed in Korean Patent Application No. 2000-0086775. A constant-speed compressor is adopted as the pulse width modulation type compressor. The constant-speed compressor is provided with a pulse width modulation valve to vary an amount of discharged refrigerant with an accumulated amount of discharged refrigerant varied by controlling an ON/OFF ratio of the pulse width modulation valve. For example, when the pulse width modulation valve is turned on (i.e., opened), the compressor is switched to an idle state so refrigerant is not discharged. In contrast, when the pulse width modulation valve is turned off (i.e., dosed), the amount of discharged refrigerant reaches 100% of a total amount. Thus, as described above, the accumulated amount of discharged refrigerant is varied by controlling the ON/OFF ratio of the pulse width modulation valve.

One characteristic of the pulse width modulation type compressor is that a variable range of a capacity of the compressor, which is determined according to loads of indoor air conditioning units, vary as widely as 10 to 100% of its rated capacity. An inverter type compressor has an available minimal capacity of about 30% of its rated capacity because of difficulty in restoring oil during its low capacity operation, whereas the pulse width modulation compressor may restore oil even during its low capacity operation because 100% of refrigerant is instantly discharged when the pulse width modulation valve is turned off. Thus, the pulse width modulation type compressor allows a low capacity operation at 10% of its rated capacity.

Accordingly, the system air conditioner employing the pulse width modulation type compressor may accomplish air conditioning for indoor spaces having different volumes ranging from small to large because of its ability to manage various types of indoor units and its wide capacity range of 10 to 100% of the compressor's rated capacity In addition, differently from a generally small-sized air conditioner in which a ratio of a capacity of a compressor to a load of the compressor is about 1:1 and a corresponding small amount of refrigerant is supplied, the system air conditioner may manage a large capacity compressor and require a large amount of refrigerant.

Since the small-sized air conditioner may have a relative small amount of refrigerant for a volume of an indoor space, leaked refrigerant may be spread over a relatively wide space. Consequently, since an amount of supplied refrigerant in a building equipped with the system air conditioner is large, a large amount of refrigerant can accumulate in an indoor space.

FIG. 1 is a view showing an air conditioner employing a pulse width modulation type compressor, according to an embodiment of the present invention. As shown in FIG. 1, an air conditioner 100 includes a compressor 104, an outdoor heat exchanger 106, electric expansion valves 108 and indoor exchangers 110, which are connected by refrigerant pipes to form a dosed circuit. Of the refrigerant pipes, a high pressure refrigerant pipe 112 connects an outlet side of the compressor 104 of the outdoor unit 116 and inlet sides of the electric expansion valves 108. The high pressure pipe 112 guides a flow of high pressure refrigerant discharged from the compressor 104. A low pressure refrigerant pipe 114 connects outlet sides of the electric expansion valves 108 and an inlet side of the compressor 104 of the outdoor unit 116. The low pressure pipe 114 guides a flow of low pressure refrigerant expanded by the electric expansion valves 108. The outdoor heat exchanger 106 is installed within the outdoor unit 116 on the high pressure pipe 112. The indoor heat exchangers 110 are installed within indoor units of an indoor unit arrangement 118 on the low pressure pipe 114. When the compressor 104 is operated in a cooling mode, refrigerant flows in directions indicated by the solid arrows shown in FIG. 1. The high pressure pipe 112 is connected to a service port 158 through which refrigerant is supplemented with additional refrigerant.

As the air conditioner 100 of the present invention includes the outdoor unit 116 and the indoor unit arrangement 118, the outdoor unit 116 includes the compressor 104 and the outdoor heat exchanger 106 as described above. The outdoor unit 116 also includes an accumulator 120 installed on the low pressure pipe 114 positioned upstream of the compressor 104, and a receiver 122 installed on the high pressure pipe 112 positioned downstream of the outdoor heat exchanger 106. The accumulator 120 collects and evaporates liquid refrigerant that has not been evaporated in the indoor heat exchangers 110 to allow the evaporated refrigerant to flow into the compressor 104. In other words, if the liquid refrigerant is not completely evaporated in the indoor heat exchangers 110, the refrigerant flowing into the accumulator 120 is a mixture of liquid and gas. The accumulator 120 evaporates only the liquid refrigerant such that only a gaseous refrigerant is compressed. For this reason, an inlet and outlet of the refrigerant pipe within the accumulator 120 are preferably positioned in an upper portion of the accumulator 120.

If the refrigerant is not completely condensed in the outdoor heat exchanger 106, the refrigerant flowing into the receiver 122 is a mixture of liquid and gas. The receiver 122 is configured to allow an inlet and outlet of the refrigerant pipe therein to be extended up to a lower portion of the receiver 122 so as to separate liquid refrigerant and gaseous refrigerant such that only liquid refrigerant flows out of it.

A vent bypass pipe 124 is provided to connect the receiver 122 and the low pressure pipe 114 positioned upstream of the accumulator 120 so that the gaseous refrigerant within the receiver 122 is bypassed. An inlet of the vent bypass pipe 124 is provided in an upper portion of the receiver 122 to allow only the gaseous refrigerant to flow into the vent bypass pipe 124, while a vent valve 126 is provided in the vent bypass pipe 124 so as to control a flow rate of bypassed gaseous refrigerant. An arrow positioned along the vent bypass pipe 124 and indicated by a dotted line in FIG. 1 represents a direction of a flow of the bypassed gaseous refrigerant.

The high pressure pipe 112 extended from the receiver 122 is configured to pass through the accumulator 120 so as to evaporate the liquid refrigerant of relatively low temperature within the accumulator 120 using refrigerant of relatively high temperature passing through the high pressure pipe 112. For the purpose of accomplishing effective evaporation in the accumulator 120, a low pressure refrigerant pipe 121 within the accumulator 120 is formed to have a U shape, and a high pressure refrigerant pipe 123 having a U shape passes through the accumulator 120.

The outdoor unit 116 further includes a hot gas bypass pipe 128 connecting the accumulator 120 to the high pressure pipe 112 between the compressor 104 and the outdoor heat exchanger 106, and a liquid bypass pipe 130 located downstream of the receiver 122 to a pipe located downstream of the accumulator 120. A hot gas valve 132 to control a flow rate of bypassed hot gas is provided in the hot gas bypass pipe 128, while a liquid valve 134 to control a flow rate of bypassed liquid refrigerant is provided on the liquid bypass pipe 130. Accordingly, when the hot gas valve 132 is opened, a portion of hot gas coming out of the compressor 104 flows in a direction indicated by a dotted arrow along the hot gas bypass pipe 128, while when the liquid valve 134 is opened, a portion of the liquid refrigerant coming out of the receiver 122 flows in a direction indicated by a dotted arrow parallel to the liquid bypass pipe 130.

A high pressure pipe shutoff valve 154 is provided on the high pressure refrigerant pipe 123 to connect the accumulator 120 and the indoor unit arrangement 118. In case of refrigerant leakage, the high pressure pipe shutoff valve 154 is closed (turned off) such that the refrigerant discharged from the compressor 104 does not flow into the indoor unit arrangement 118. In addition, a low pressure pipe shutoff valve 156 is provided on the low pressure pipe 114 of the outdoor unit 116 such that a flow of refrigerant between the outdoor unit 116 and the indoor unit arrangement 118 is prevented.

The indoor unit arrangement 118 includes a plurality of indoor units 118' that are connected in parallel to one another. Each of the indoor units 118' includes one electric expansion valve 108, one indoor heat exchanger 110 and a sensor unit 152. Thus, the air conditioner 100 of the present invention has a configuration in which a plurality of indoor units 118' is connected to a single outdoor unit 116, and the indoor units 118' may be similar or different in their shapes and capacities.

Figure 2:
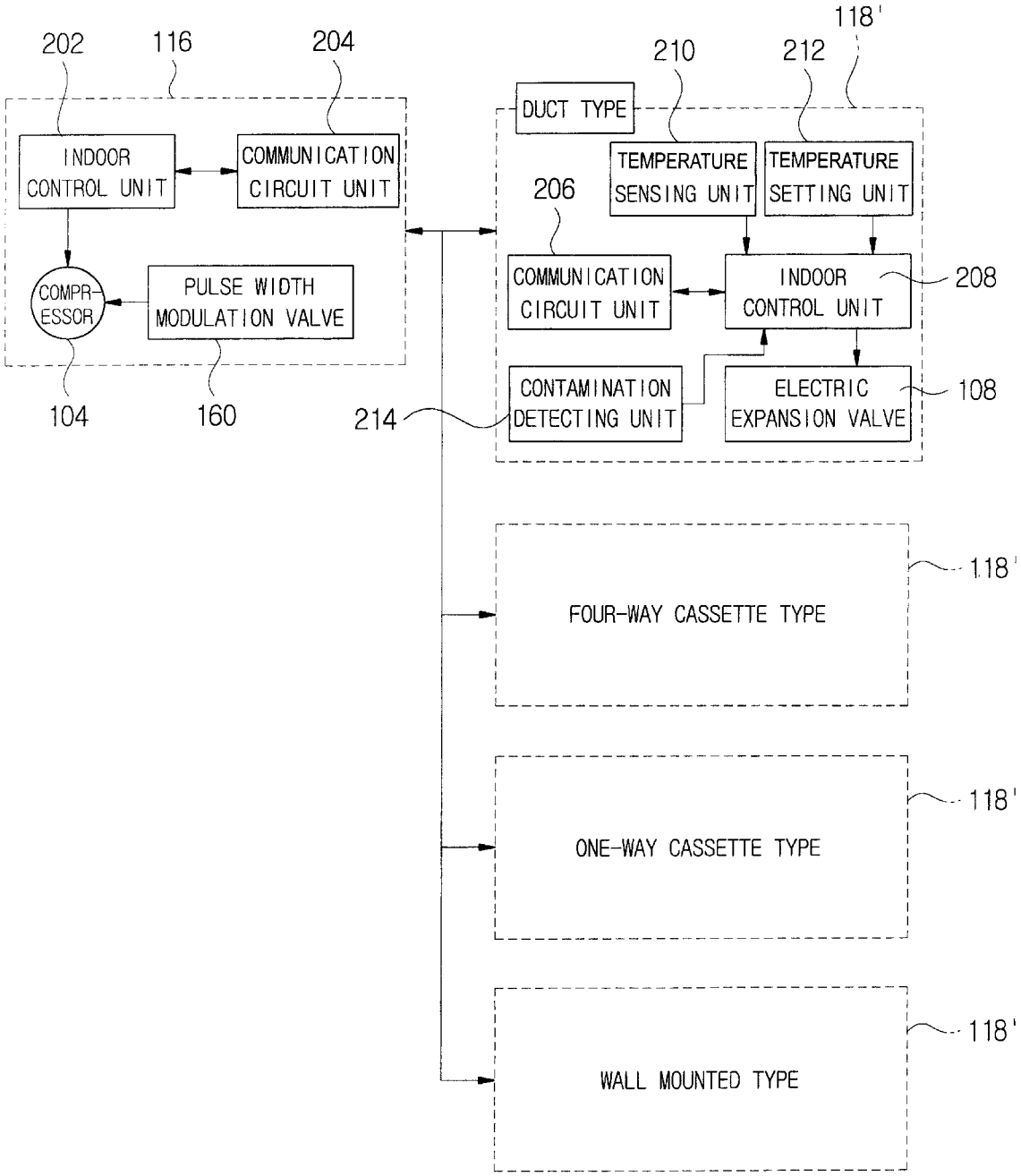
FIG. 2 is a block diagram showing a control system of the air conditioner of FIG. 1.

FIG. 2 is a block diagram showing a control system of the air conditioner of FIG. 1. As shown in FIG. 2, the outdoor unit 116 includes the compressor 104, a pulse width modulation valve 160, and an outdoor control unit 202 connected to the compressor 104 and the pulse width modulation valve 160. The outdoor control unit 202 is also connected to an outdoor communication circuit unit 204 to receive and transmit data therefrom and thereto. Each indoor unit 118' of the indoor unit arrangement 118 includes an indoor control unit 208, a temperature sensing unit 210 connected to an input part of the indoor control unit 208, a temperature setting unit 212, a contamination detecting unit 214 and the electric expansion valve 108, which is connected to an output port of the indoor control unit 208. The temperature sensing unit 210 connected to an input port of the indoor control unit 208, is a temperature sensor to sense a temperature of a room in which the' indoor unit 118' is installed. A required air conditioning capacity is calculated on the basis of the temperature sensed by the temperature sensing unit 210. Instead of the temperature sensing unit 210, a pressure sensor to sense a pressure of refrigerant may be used. The temperature sensor and the pressure sensor of the temperature sensing unit 210 are load sensors to calculate the required air conditioning capacity ( i.e., loads ) of the indoor unit 118'.

An oxygen concentration detecting sensor or a Freon detecting sensor to detect contamination of indoor air may be used as the contamination detecting unit 214. When the oxygen concentration detecting sensor is used as the contamination detecting unit 214, it is installed near an air inlet hole of the indoor unit 118' to ascertain a presence of refrigerant leakage by measuring the oxygen concentration of indoor air flowing into the indoor unit 118' and detecting a degree of air contamination. If Freon gas is used as. refrigerant, the Freon detecting sensor is used to ascertain a presence of refrigerant leakage by detecting whether Freon gas is included in sucked air.

The indoor unit 118' further includes an indoor communication circuit unit 206 connected to the indoor control unit 208. The outdoor and indoor communication circuit units 204 and 206 are connected to each other in a wire or wireless data communication manner. The above-described construction is similar for a four-way cassette type indoor unit, a one-way cassette type indoor unit, a wall mounted type indoor unit, etc.

The indoor control unit 208 calculates the required air conditioning capacity of the indoor unit 118' based on a difference between a room temperature sensed by the temperature sensing unit 210 and a temperature preset by the temperature setting unit 212. In addition, since the indoor control unit 208 contains information on its air conditioning capacity, it calculates the required air conditioning capacity based on its air conditioning capacity and the difference between the room temperature and the preset temperature.

Figure 3:
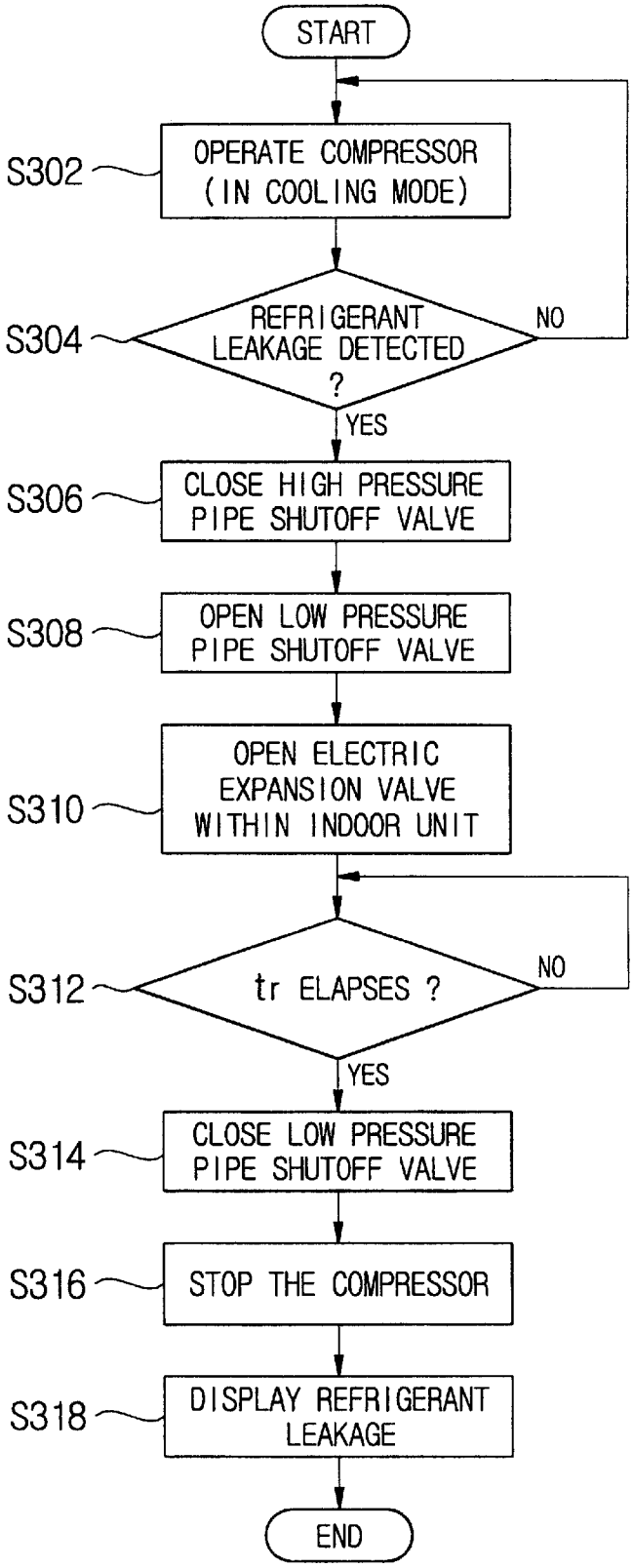
FIG. 3 is a flowchart showing a refrigerant leakage preventing method in a cooling mode of the air conditioner.
Figure 4:
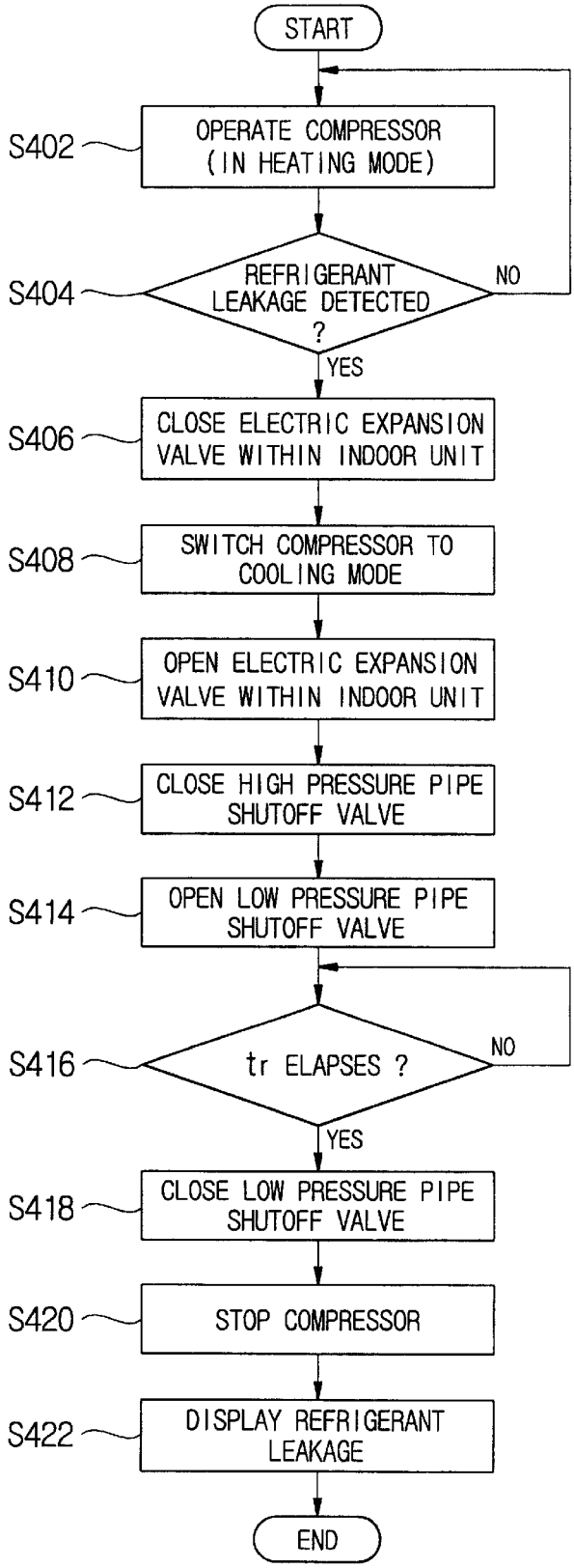
FIG. 4 is a flowchart showing a refrigerant leakage preventing method in a heating mode of the air conditioner.
Figure 5:
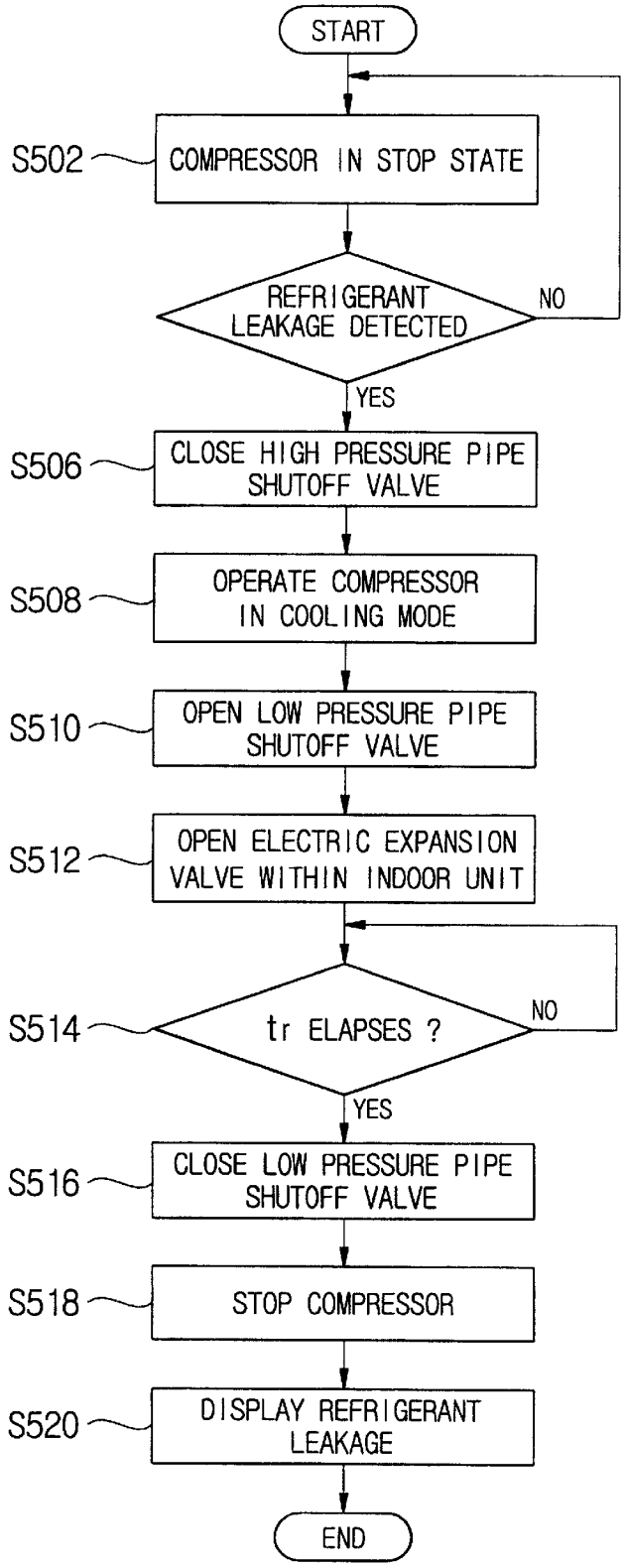
FIG. 5 is a flowchart showing a refrigerant leakage preventing method when the refrigerant leakage occurs while a compressor of the air conditioner is stopped.

FIGS. 3 through 5 are flowcharts showing refrigerant leakage preventing methods according to embodiments of the present invention. The refrigerant leakage preventing methods are different depending on operation modes of the compressor 104, which are divided into a cooling mode, a heating mode, and a mode in which the compressor 104 is stopped.

FIG. 3 is a flowchart showing a refrigerant leakage preventing method in the cooling mode of the air conditioner. As shown in FIG. 3, when the refrigerant leakage is detected at operation 304 while the compressor 104 is operating in a cooling mode at operation 302, the high pressure pipe shutoff valve 154 is dosed such that the refrigerant discharged from the compressor 104 does not flow into the indoor unit arrangement 118 at operation 306. Simultaneously, the low pressure pipe shutoff valve 156 is completely opened such that the refrigerant within the indoor unit arrangement 118 flows into the inlet side of the compressor 104 at operation 308. In this state, when the electric expansion valves 108 are completely opened, refrigerant within the indoor unit arrangement 118 is restored into the outdoor unit 116 at operation 310. After the refrigerant restoration is carried out for a preset period of refrigerant restoration time t, all the refrigerant within the indoor unit arrangement 118 may be restored into the outdoor unit 116 at operation 312. The preset period of refrigerant restoration time $t_r$, which is a period of time taken to restore all refrigerant supplied to the indoor unit arrangement 118, depends on the amount of refrigerant supplied to the air conditioner 100 and lengths of the refrigerant pipes. If the refrigerant leakage is not detected in the refrigerant leakage detecting operation S304, the compressor operation in operation S302 continues until the refrigerant leakage is detected at operation S304. When the preset period of refrigerant restoration time relapses at operation 312, the low pressure pipe shutoff valve 156 is closed such that a portion of the refrigerant pipe between the inlet side of the compressor 104 and the indoor unit arrangement 118 is blocked at operation 314. Thereafter, the compressor 104 is stopped at operation 316 and the refrigerant leakage is displayed on displays (not shown) provided in indoor units 118' at operation 318.

FIG. 4 is a flowchart showing a refrigerant leakage preventing method in the heating mode of the air conditioner. As shown in FIG. 4, when the refrigerant leakage is detected at operation 404 while the compressor 104 is operated in the heating mode at operation 402, the electric expansion valves 108 in the indoor units 118', in which the refrigerant leakage occurs, is dosed such that a portion of the refrigerant pipe connected to the indoor units 118' is blocked at operation 406. Subsequently, after the compressor 104 is switched to a cooling mode at operation 408 to start the cooling operation of the compressor 104, the electric expansion valves 108 are opened at operation 410. In this state, the high pressure pipe shutoff valve 154 is dosed such that refrigerant discharged from the compressor 104 does not flow into the indoor unit arrangement 118 at operation 412. Simultaneously, the low pressure pipe shutoff valve 156 is completely opened such that the refrigerant within the indoor unit arrangement 118 flows into the inlet side of the compressor 104 so as to restore the refrigerant into the outdoor unit 116 at operation 414. After the refrigerant restoration is carried out for a preset period of refrigerant restoration time $t_r$, all the refrigerant within the indoor unit arrangement 118 may be restored into the outdoor unit 116 at operation 416. If the refrigerant leakage is not detected in the refrigerant leakage detecting operation S404, the compressor operation in operation S402 continues until the refrigerant leakage is detected at operation S404. When the preset period of refrigerant restoration time $t_r$ elapses at operation 416, the low pressure pipe shutoff valve 156 is dosed such that a portion of the refrigerant pipe between the inlet side of the compressor 104 and the indoor unit arrangement 118 is blocked at operation 418. Thereafter, the compressor 104 is stopped at operation S420, and the refrigerant leakage is displayed on displays (not shown) provided in the indoor units 118' at operation 422.

FIG. 5 is a flowchart showing a refrigerant leakage preventing method when the refrigerant leakage occurs while the compressor of the air conditioner is stopped. As shown in FIG. 5, when the refrigerant leakage is detected at operation S504 while the compressor 104 is stopped at operation 502, the high pressure pipe shutoff valve 154 is closed such that the outlet side of the compressor 104 is separated from the indoor unit arrangement 118 at operation S506. Subsequently, after the compressor 104 is operated in the cooling mode at operation S508, the low pressure pipe shutoff valve 156 is completely opened such that the refrigerant within the indoor unit arrangement 118 flows into the inlet side of the compressor 104 so as to restore the refrigerant into the outdoor unit 116 at operation 510. In this state, when the electric expansion valves 108 are completely opened, the refrigerant within the indoor unit arrangement 118 is restored into the outdoor unit 116 at operation 512. After the refrigerant restoration is carried out for a preset period of refrigerant restoration time $t_r$, all the refrigerant within the indoor unit arrangement 118 may be restored into the outdoor unit 116 at operation 514. If the refrigerant leakage is not detected in the refrigerant leakage detecting operation S504, the compressor operation in operation S502 continues until the refrigerant leakage is detected at operation 504. When the preset period of refrigerant restoration time $t_r$ elapses at operation 514, the low pressure pipe shutoff valve 156 is. dosed such that a portion of the refrigerant pipe between the inlet side of the compressor 104 and the indoor unit arrangement 118 is blocked at operation 516. Thereafter, the compressor 104 is stopped at operation 518 and the refrigerant leakage is displayed on displays (not shown) provided in the indoor units 118' at operation 520.

As described above, the present invention provides an air conditioner and method of controlling the same, which is capable of rapidly shutting off refrigerant supply when refrigerant is leaked out of a refrigerant pipe connected to one or more indoor units, and restoring the leaked refrigerant into an outdoor unit. Thus, a leakage amount of refrigerant into a small indoor space is prevented, and a loss of refrigerant is minimized.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A method of controlling an air conditioner which includes an indoor unit and an outdoor unit, comprising:

shutting off a refrigerant supply when refrigerant is leaked out of a refrigerant pipe connected to the indoor unit; and restoring the refrigerant into the outdoor unit if the refrigerant has leaked.

2. A method of controlling an air conditioner having an outdoor unit, an indoor unit and a compressor, the outdoor unit being connected to the indoor unit by first and second refrigerant pipes to form a dosed circuit through which refrigerant passes, and first and second pipe shutoff valves to control a flow of the refrigerant through the first and second refrigerant pipes, the method comprising:

detecting a refrigerant leakage with a refrigerant leakage detecting unit provided on the indoor unit;

shutting off the flow of the refrigerant from the outdoor unit to the indoor unit when the refrigerant leakage is detected; and restoring the refrigerant within the indoor unit into the outdoor unit by dosing the first pipe shutoff valve and opening the second pipe shutoff valve when the refrigerant leakage is detected.

3. A method of controlling an air conditioner, the air conditioner having an outdoor unit, an indoor unit, a compressor, an electric expansion valve at the indoor unit, a high pressure pipe cutoff valve and a low pressure cutoff valve at the outdoor unit, the outdoor unit being connected to the indoor unit by low and high pressure refrigerant pipes to form a closed circuit, the electric expansion valve being provided on the refrigerant pipe to vary a pressure of refrigerant flowing into the indoor unit, the high pressure pipe shutoff valve being provided on the high pressure refrigerant pipe, and the low pressure pipe shutoff valve provided on the low pressure refrigerant pipe, the method comprising:

restoring the refrigerant to the outdoor unit from the indoor unit by keeping the high pressure pipe shutoff valve dosed and the low pressure pipe shutoff valve opened for a preset period of time when a refrigerant leakage is detected; and dosing the low pressure pipe shutoff valve and stopping the compressor when the preset period of time elapses.

4. The method according to claim 3, further comprising:

selectively operating the compressor in one of a cooling mode, heating mode, and compressor-stopped state when the leakage is detected.

5. By The method according to claim 4, wherein the selectively operating the compressor and the restoring the refrigerant to the outdoor unit comprises:

opening the electric expansion valve provided in the indoor unit if the refrigerant leakage is detected while the compressor is operated in the cooling mode, thereby allowing the leaked refrigerant to be restored into the outdoor unit.

6. The method according to claim 4, wherein the selectively operating the compressor and the restoring the leaked refrigerant comprises:

dosing the electric expansion valve provided in the indoor unit;

switching the compressor to the cooling mode; and opening the electric expansion valve provided in the indoor unit, if the refrigerant leakage is detected while the compressor is operated in the heating mode, thereby allowing the leaked refrigerant to be restored into the outdoor unit.

7. The method according to claim 4, wherein the restoring the leaked refrigerant is performed after dosing the high pressure pipe shutoff valve and operating the compressor in the cooling mode, if the refrigerant leakage is detected while the compressor is stopped.

8. The method according to claim 3, wherein the air conditioner is a system air conditioner in which a plurality of indoor units are connected to a single outdoor unit.

9. The method according to claim 3, wherein after the restoring leaked refrigerant is performed for the preset period of time, all of the refrigerant provided to the indoor unit is restored into the outdoor unit.

10. The method according to claim 3, wherein the preset period of time is determined based on a total amount of refrigerant supplied to the air conditioner and a length of the refrigerant pipe divided into the high and low pressure pipes.

11. An air conditioner, comprising:

an outdoor unit;

an indoor unit, the outdoor unit being connected to the indoor unit by low and high pressure refrigerant pipes to form a closed circuit;

a compressor disposed in the outdoor unit and connected to the low and high pressure refrigerant pipes;

a refrigerant leakage detecting unit provided on the indoor unit to detect a refrigerant leakage;

a high pressure pipe shutoff valve provided at the high pressure pipe to shut off a flow of refrigerant between the outdoor unit and the indoor unit when the refrigerant leakage is detected; and a low pressure pipe shutoff valve provided at the low pressure pipe to shut off a flow of refrigerant between the outdoor unit and the indoor unit when the refrigerant leakage is detected, wherein the refrigerant within the indoor unit is restored into the outdoor unit by operating the compressor while dosing the high pressure pipe shutoff valve and opening the low pressure pipe shutoff valve when the refrigerant leakage is detected.

12. The air conditioner according to claim 11, wherein the compressor is selectively operated in one a cooling mode, heating mode, and compressor-stopped state when the refrigerant leakage is detected.

13. The air conditioner according to claim 12, wherein when the compressor operates in the cooling mode, the high pressure pipe shutoff valve is dosed and the low pressure pipe shutoff valve is opened if the refrigerant leakage is detected, thereby allowing the leaked refrigerant to be restored into the outdoor unit.

14. The air conditioner according to claim 12, wherein when the compressor operates in the heating mode, the compressor is switched to the cooling mode and the refrigerant within the indoor unit is restored into the outdoor unit, if the refrigerant leakage is detected, thereby allowing the leaked refrigerant to be restored into the outdoor unit.

15. The air conditioner according to claim 12, wherein in the compressor-stopped state, the high pressure pipe shutoff valve is dosed, the compressor is switched to operate in the cooling mode, and the low pressure pipe shutoff valve is opened, if the refrigerant leakage is detected, thereby allowing the leaked refrigerant to be restored into the outdoor unit.

16. The air conditioner according to claim 11, wherein the compressor is a pulse width modulation type compressor equipped with a pulse width modulation valve.

17. The air conditioner according to claim 11, wherein the air conditioner is a system air conditioner in which a plurality of indoor units are connected to a single outdoor unit.

18. An air conditioner, comprising:

an indoor unit having a sensing unit and an indoor control unit to calculate a required air conditioning capacity and to detect a leakage of the refrigerant using the sensing unit; and an outdoor unit having an outdoor control unit in communication with the indoor control unit, and a compressor controlled by the outdoor control unit to provide refrigerant to and from the indoor unit in accordance with the calculated required air conditioning capacity, and, if the leakage of the refrigerant is detected by the indoor control unit, the outdoor control unit controls the compressor to the remove the refrigerant from the indoor unit to the outdoor unit.

19. The air conditioner according to claim 18, further comprising pipes transporting the refrigerant between the indoor and outdoor units forming a dosed circuit, and wherein:

the outdoor unit further comprises:

a first pipe shutoff valve provided at one of the pipes to shut off a first flow of the refrigerant from the outdoor unit to the indoor unit; and a second pipe shutoff valve provided at another one of the pipes to shut off a second flow of the refrigerant from the indoor unit to the outdoor unit, and when the refrigerant leakage is detected, the outdoor control unit removes the refrigerant within the indoor unit into the outdoor unit by operating the compressor while dosing the first pipe shutoff valve to shut off the first flow from the outdoor unit to the indoor unit and opening the second pipe shutoff valve to allow the second flow from the indoor unit to the outdoor unit.

* * * * *